US006079554A

United States Patent [19]

Hammett et al.

[11] Patent Number: 6,079,554

[45] **Date of Patent: *Jun. 27, 2000**

[54] BEVERAGE CAN TRAY WITH IMPROVED HANDLING FEATURES

[75] Inventors: Roy Hammett, Tampa, Fla.; Douglas H. Heilman, Wake Forest, N.C.

[73] Assignee: International Container Systems, Inc., Fla.

[ * ] Notice: This patent is subject to a terminal disclaimer.

[21] Appl. No.: 09/111,319

[22] Filed: Jul. 7, 1998

Related U.S. Application Data

[63] Continuation-in-part of application No. 08/889,267, Jul. 8, 1997, Pat. No. 5,785,170, which is a continuation of application No. 08/590,146, Jan. 23, 1996, abandoned.

[51] Int. Cl.[7] ..... B65D 75/00

[52] U.S. Cl. ..... 206/203; 206/509; 220/516

[58] Field of Search ..... 206/203, 139, 206/427, 505, 509; 220/509, 512, 515, 516, 517, 519

[56] References Cited

U.S. PATENT DOCUMENTS

| | | |
|---|---|---|
| D. 208,111 | 7/1967 | Vidal . |
| D. 317,670 | 6/1991 | Apps . |
| D. 322,917 | 1/1992 | Morris et al. . |
| D. 329,932 | 9/1992 | Apps . |
| D. 330,621 | 10/1992 | Apps . |
| D. 347,722 | 6/1994 | Apps . |
| 2,215,252 | 9/1940 | Randall et al. . |
| 2,965,226 | 12/1960 | Ettlinger et al. . |
| 3,009,579 | 11/1961 | Ettlinger et al. . |
| 3,092,284 | 6/1963 | Stout . |
| 3,151,762 | 10/1964 | Vidal . |
| 3,155,268 | 11/1964 | Fogerty et al. . |
| 3,333,727 | 8/1967 | Belcher et al. . |
| 3,334,767 | 8/1967 | Corneleus et al. . |
| 3,349,943 | 10/1967 | Box . |
| 3,351,264 | 11/1967 | Bostrom . |
| 3,369,659 | 2/1968 | Ettlinger, Jr. . |
| 3,391,814 | 7/1968 | Box . |
| 3,391,815 | 7/1968 | Box . |
| 3,638,824 | 2/1972 | Sekiguchi et al. . |
| 3,791,549 | 2/1974 | Delbrouck et al. . |
| 4,161,259 | 7/1979 | Palafox . |
| 4,162,738 | 7/1979 | Wright . |
| 4,204,617 | 5/1980 | Hirota . |
| 4,319,685 | 3/1982 | David . |
| 4,410,099 | 10/1983 | De Larosiere . |
| 4,615,444 | 10/1986 | De Larosiere . |
| 4,625,908 | 12/1986 | Emery . |

(List continued on next page.)

FOREIGN PATENT DOCUMENTS

| | | |
|---|---|---|
| 1474782 | 3/1967 | France . |
| 1152038 | 5/1969 | United Kingdom . |
| 1197058 | 1/1970 | United Kingdom . |
| 1330778 | 9/1973 | United Kingdom . |
| 2032886 | 5/1980 | United Kingdom . |

*Primary Examiner*—Paul T. Sewell
*Assistant Examiner*—Nhan T. Lam
*Attorney, Agent, or Firm*—Dennis H. Lambert

[57] ABSTRACT

A tray for holding a plurality of beverage containers has a floor with a plurality of container seating areas on its top surface and structure on its bottom surface to enable a plurality of the trays loaded with containers to be stacked on top of one another in stable relationship, yet slid relatively easily on top of one another when desired. Peripheral heel protector bands extend around the periphery of the tray to protect the lower ends of containers from damage, and spacer members project upwardly from the floor between the container seating areas to maintain containers in the tray spaced from one another and prevent displacement of the containers from their seating areas when the tray is tilted. A tray sidewall includes spaced pillars extending upwardly from the periphery of the floor and supporting a top rail at their upper ends. A plurality of denesting straps extend between the heel protector bands and the top rail in the spaces between the pillars to prevent snagging of the heel protector bands on the top rail during denesting of a stack of empty trays.

15 Claims, 15 Drawing Sheets

U.S. PATENT DOCUMENTS 4,700,836 10/1987 Hammett .
4,700,837 10/1987 Hammett .
4,789,063 12/1988 Hammett .
4,834,243 5/1989 Langenbeck .
4,899,874 2/1990 Apps et al. .
4,928,841 5/1990 Arthurs .
4,932,532 6/1990 Apps et al. .
4,944,400 7/1990 Van Onstein et al. .
5,031,761 7/1991 De Larosiere .
5,031,774 7/1991 Morris et al. .
5,060,819 10/1991 Apps .
5,105,948 4/1992 Morris et al. .
5,115,937 5/1992 Chausse et al. .
5,184,748 2/1993 Apps ..... 220/519
5,188,233 2/1993 Hammett .
5,230,601 7/1993 Apps et al. .
5,277,316 1/1994 Apps et al. .
5,285,899 2/1994 Apps et al. .
5,305,884 4/1994 Apps et al. ..... 206/519

FIG. 7
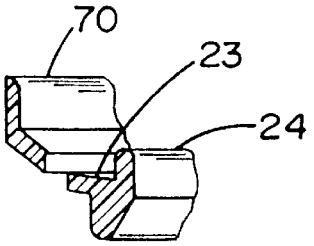
FIG. 8
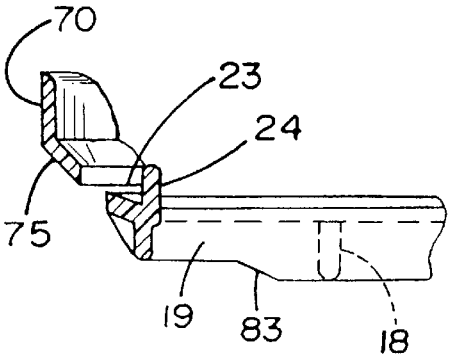
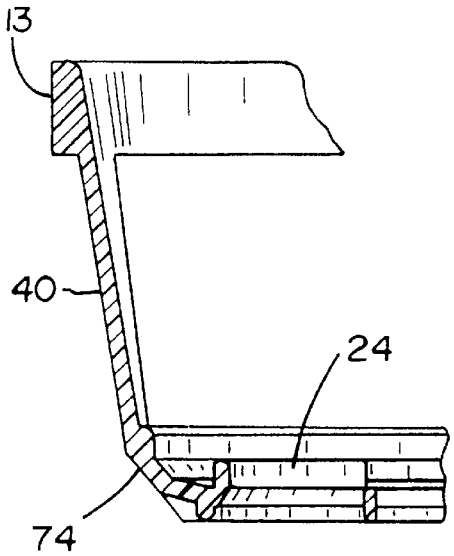
FIG. 9
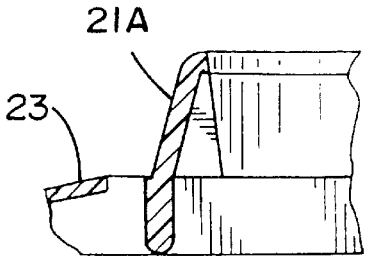
FIG. 10

BEVERAGE CAN TRAY WITH IMPROVED HANDLING FEATURES

RELATED APPLICATIONS

This application is a continuation-in-part of application Ser. No. 08/889,267, filed Jul. 8, 1997, now U.S. Pat. No. 5,785,170, which is a continuation of application Ser. No. 08/590,146, filed Jan. 23, 1996, and now abandoned.

BACKGROUND OF THE INVENTION

1. Technical Field

This invention relates to packaging, and more particularly to packaging for containers of beverage. Specifically, the invention relates to a tray for holding cans of beverage during storage, shipment and handling.

2. Prior Art

Beverages, e.g., beer and soft drinks, are typically marketed in containers such as cans or bottles. These cans and bottles, especially in sizes up to about sixteen ounces, are frequently bundled in groups of six, eight or twelve cans or bottles for marketing to consumers. To facilitate handling, whether bundled together in pre-packaged groups or left loose, the cans and bottles are typically packaged in cartons or trays holding from four to twenty-four containers of beverage, depending upon the size of the containers.

Reusable molded plastic trays have been developed for cans, especially, to support the cans in groups of twenty-four for ease of handling during storage and shipment. These prior art trays have structure on their bottom surface to enable a plurality of trays filled with cans of beverage to be stacked on top of one another in stable relationship. This bottom structure also provides for lateral sliding movement of a tray across the tops of cans supported in a lower tray, when it is desired to remove a tray from the stack. Features are also provided in prior art trays to enable nestable stacking of empty trays without shingling or wedging together of the trays.

Conventional beverage can trays are typically of low depth construction and have an inner bottom surface that defines a plurality of can seating areas on which cans of beverage are supported, and generally include a side wall or top rail spaced from the bottom of the tray and which defines the outer perimeter and top of the tray. In conventional trays, this top rail is typically spaced about two inches or less from the bottom of the tray. Moreover, in trays having the top rail supported from the bottom by spaced pillars or columns, bottom portions of the outer rows of the cans are exposed through the spaces in the sides of the tray between the columns, and are susceptible to being damaged during hand-cart or forklift handling of the trays. Additionally, the top surface of a conventional tray bottom is generally relatively flat. When a route driver is transferring cans from the tray into a vending machine, for example, the tray may be held at a relatively steep angle, and the cans can shift and slide in the tray, thereby increasing the difficulty and time required to perform the task.

Further, route drivers generally handle the trays by grasping the top rail in one or both hands. Most conventional trays do not provide any handle means to facilitate grasping of the rail by a route driver, and handling of the tray can be awkward or uncomfortable because of contact with projections on the trays that facilitate nestable stacking of empty trays, and/or because of contact with the pillars which support the rail from the bottom. Moreover, conventional trays generally do not have any means to facilitate entry of a finger of fingers beneath the tray bottom to facilitate lifting or movement of the tray.

The tray described in applicant's prior application, Ser. No. 08/889267, solves many of the problems of the prior art. For instance, the peripheral top rail was raised, which alleviated some of the shortcomings of the prior art. Lengthening and widening of the top rail provide nestability of empty trays and eliminate contact of the rail with the outside row of cans. This non-contact minimizes damage to the body of the cans, and the minimal increase in tray outside dimensions still allows filled trays, when palletized, to obtain minimal cube size when stacked twelve layers high. Projections extending upwardly from the tray floor help maintain the cans in place when the tray is tilted, and heel protectors at the periphery of the tray floor minimize damage to the bottom wall portions of cans supported in the tray.

However, the prior tray may be subject to catching of the heel protector on one tray with the top rail on another tray during denesting of the empty trays.

Accordingly, there is need for a beverage can tray having means for overcoming the above-described shortcomings of conventional beverage can trays, including means to facilitate denesting of empty trays.

SUMMARY OF THE INVENTION

The beverage can tray of the present invention is a mid-depth, economical, molded plastic tray that has features which overcome the disadvantages associated with conventional beverage can trays, as discussed above. To this end, the tray of the invention includes uniquely configured redoubts on the bottom surface that include portions which extend in spanning relationship to the rims of cans in a sub-adjacent tray to enable stable stacking of trays while at the same time facilitating lateral movement of a tray across the tops of cans in a sub-adjacent tray.

The tray of the invention also includes heel protector means extending around the outer periphery of the bottom of the tray to prevent damage to the bottom ends of cans supported therein during handling of the tray.

Moreover, the tray of the invention includes unobstructed handle means which facilitates the comfort and ease of handling of the tray when it is grasped by a route driver or other person.

In addition, upwardly projecting spaced means are provided on the upper surface of the tray floor to maintain loose cans therein in spaced relationship to one another and prevent their free sliding movement across the bottom of the tray when the tray is partially empty and is tilted to an inclined position.

Further, the tray of the invention includes spaced means on its floor which provide a more stable columnar stack when multiple empty trays are stacked together, and has interengaging means at the top rail and pillars when the trays are stacked to provide even further stability and prevent fraying of the top rail.

Additionally, the side wall height of the tray of the invention is greater than conventional trays to provide greater stability for loose cans during handling while at the same time providing UPC label visibility on most major brands of beverage cans.

Still further, the tray of the invention includes means to facilitate denesting of empty trays. Specifically, this denesting means prevents the heel protector on one tray from catching on the top rail of another tray during denesting, especially when using high speed machinery.

The foregoing and other advantages are provided in a tray that is economical to produce and which greatly facilitates the handling of the trays and cans during use. These advantages are achieved by a molded plastic tray having a floor or bottom with a top surface and a bottom surface. The top surface is subdivided into a plurality, e.g., twenty-four, of can seating areas or pockets, with upstanding can spacer members distributed across the top surface between the can seating areas. In a preferred construction, the upwardly projecting spacer members closest to the corners of the bottom are higher than the remaining projections, and define the spaced means noted above which provide a more stable columnar stack of the trays when nested together.

The uniquely configured redoubts and strut members of the invention have portions projecting below the bottom surface of the tray for cooperative engagement with the rims of cans in a sub-adjacent tray to provide stability to a stack of trays loaded with cans, while at the same time enabling the loaded trays to be relatively easily moved laterally with respect to one another when desired. This is accomplished by providing the redoubts and struts with members which extend in spanning relationship to the rims of cans in a sub-adjacent tray to facilitate lateral sliding movement of the tray across the tops of cans in a sub-adjacent tray, but which includes portions of different elevation to enable stable stacking of loaded trays on top of one another. The portions of different elevation also include recessed areas at locations where the struts and redoubts cross, providing clearance for the pull tabs on cans in a sub-adjacent tray. Further, the redoubts and struts are configured to provide substantially coplanar contact surfaces across the length and width of the tray so that the tray will not become hung up on rollers of conveyor systems and the like.

The heel protector means comprises relatively narrow, arcuately shaped upright bands or walls extending between the pillars at their base ends, defining a generally serpentine, continuous wall around substantially the entire outer periphery of the tray to protect the heels of cans supported in the tray from damage due to contact with the blade of a hand truck or fork lift and the like. This heel protector is normally spaced from the heel of the can so that impact against the heel protector is not transferred into the wall of the can, thereby avoiding damage to the can.

The handle means in the tray of the invention include handles at the sides of the tray, formed by terminating the center pillar along each long side of the tray at the bottom edge of the top rail. This unobstructed area improves the ergonomics of the tray by providing a smooth section to be grasped by a person handling the tray. Further, termination of the pillar in this way also eliminates sink marks in the flat outer surface of the rail at this location, thereby providing a relatively smooth, unobstructed area for placement of a company logo or other graphics.

Handle means at the ends of the tray are similarly provided by omitting the center pillar at each end, leaving a free, unobstructed rail portion to serve as a handle.

The side wall height of the tray of the invention is approximately one inch greater than the side wall height of conventional low depth trays, e.g., about 2⅞ inches as compared with about 2 inches, to lend greater stability to cans supported in the tray, especially when the tray is held at a steep angle. In spite of its greater side wall height, the tray of the invention nests very compactly, with each tray occupying a vertical distance of only the width of the top rail, e.g., about 7/10 of an inch.

The means to facilitate denesting comprises a strap extended between the heel protector and the top rail. The strap does not interfere with nesting of the trays or otherwise impede handling and use of them.

The tray of the invention thus overcomes many, if not all, of the shortcomings of conventional trays, and provides features and advantages not found in prior art trays.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein:

FIG. 7 is an enlarged fragmentary sectional view taken along line 7—7 in FIG. 6;

FIG. 8 is an enlarged fragmentary sectional view taken along line 8—8 in FIG. 6;

FIG. 9 is an enlarged fragmentary sectional view taken along line 9—9 in FIG. 6;

FIG. 10 is an enlarged fragmentary sectional view taken along line 10—10 in FIG. 6;

DETAILED DESCRIPTION OF THE PREFERRED EMBODIMENTS

Figure 1:
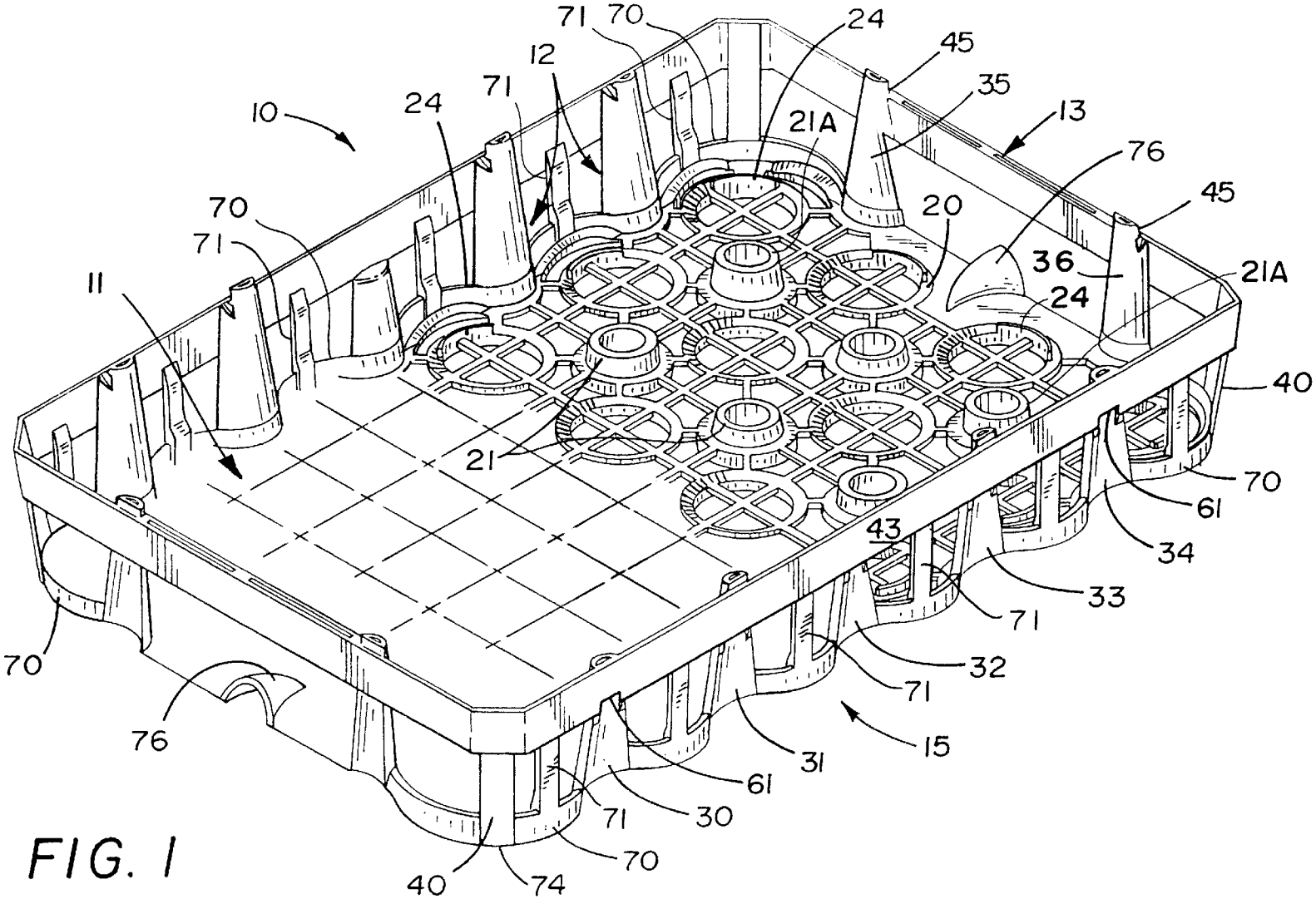
FIG. 1 is a top perspective view of the beverage can tray according to the invention.
Figure 2A:
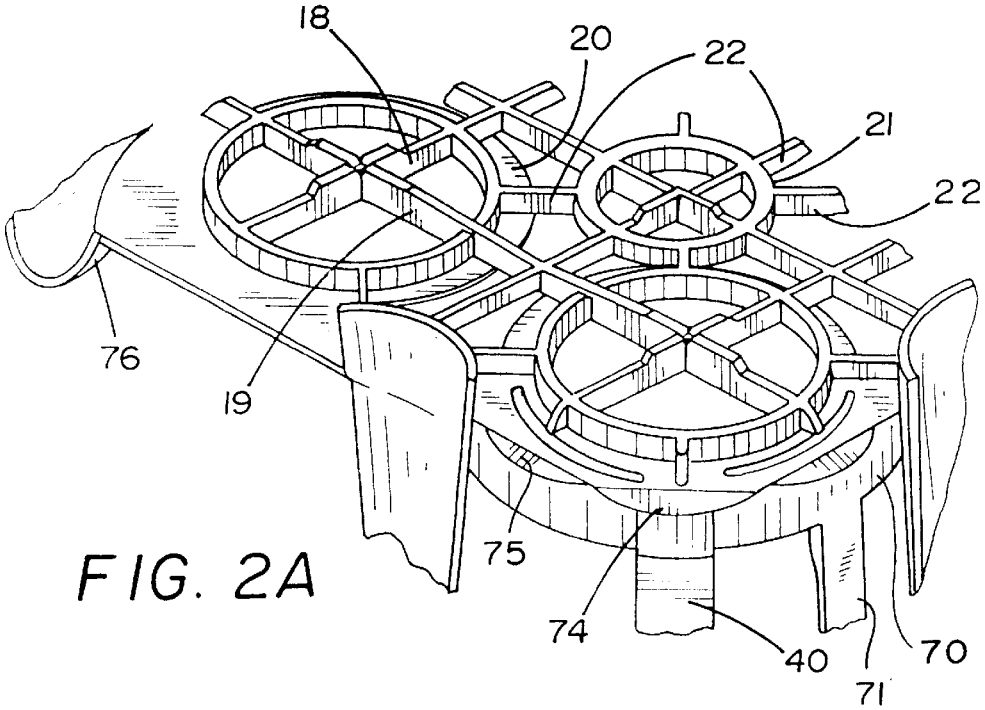
FIG. 2A is an enlarged, fragmentary, bottom perspective view of the near corner portion of the tray, as viewed in FIG. 2.
Figure 2:
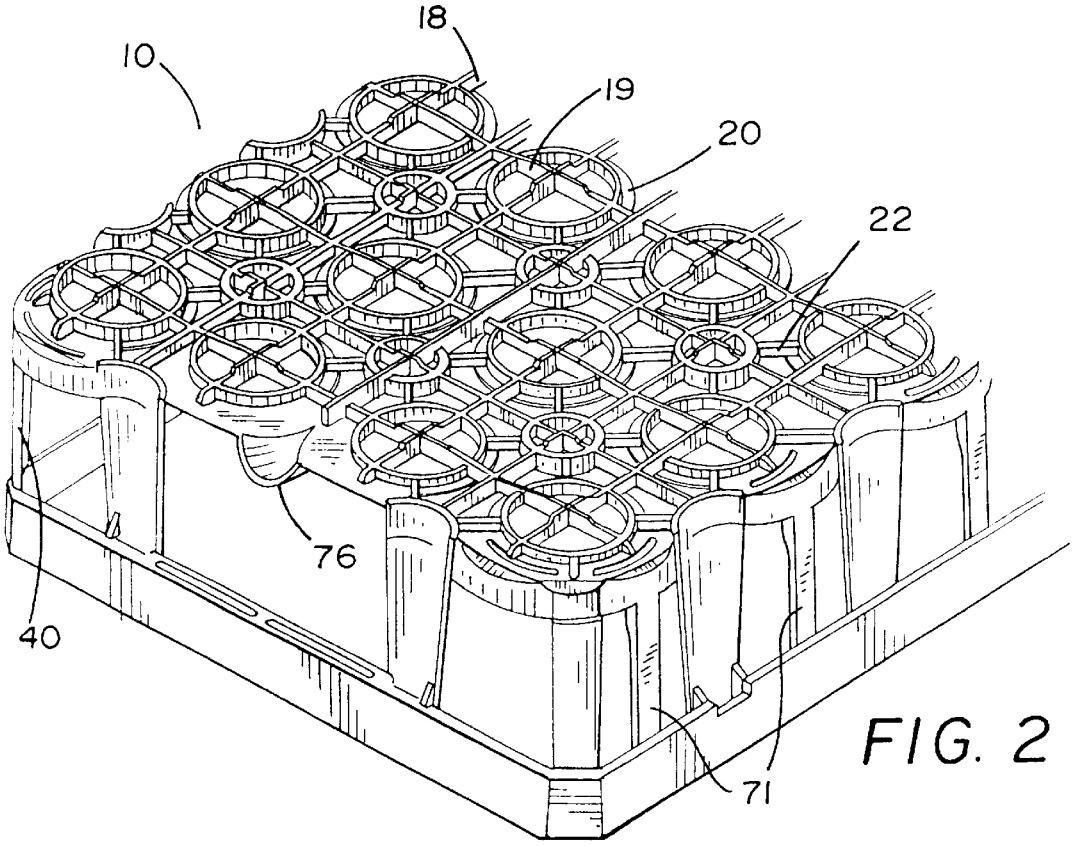
FIG. 2 is a fragmentary bottom perspective view thereof.
Figure 3:
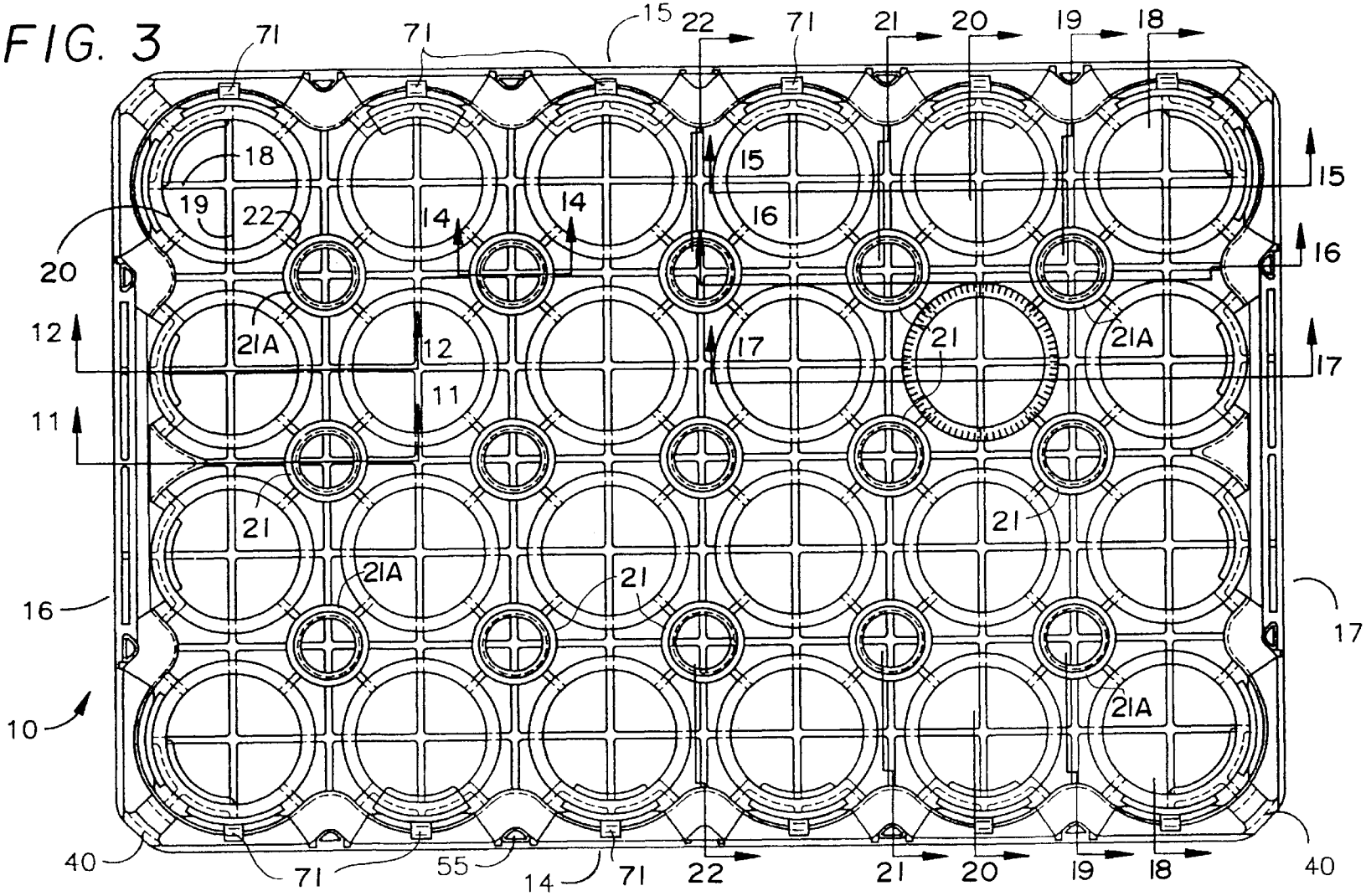
FIG. 3 is a top plan view thereof.
Figure 4:
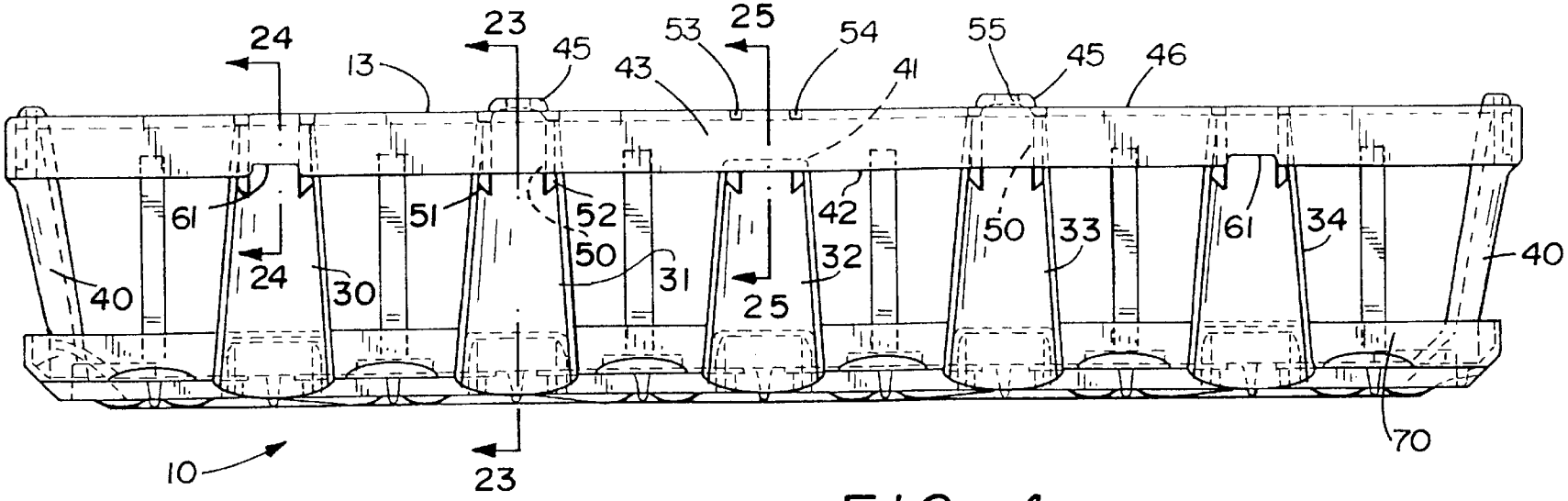
FIG. 4 is a side view in elevation thereof.
Figure 5:
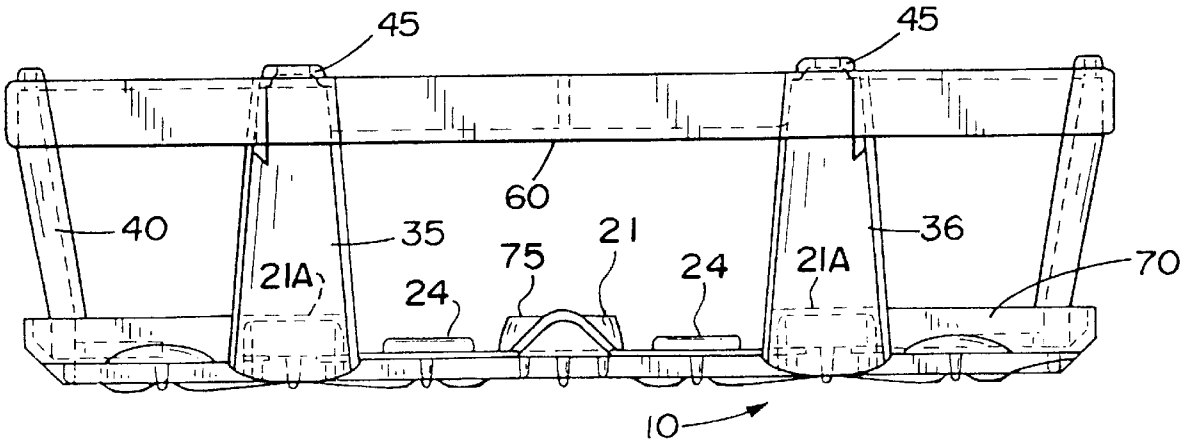
FIG. 5 is an end view in elevation thereof.
Figure 6:
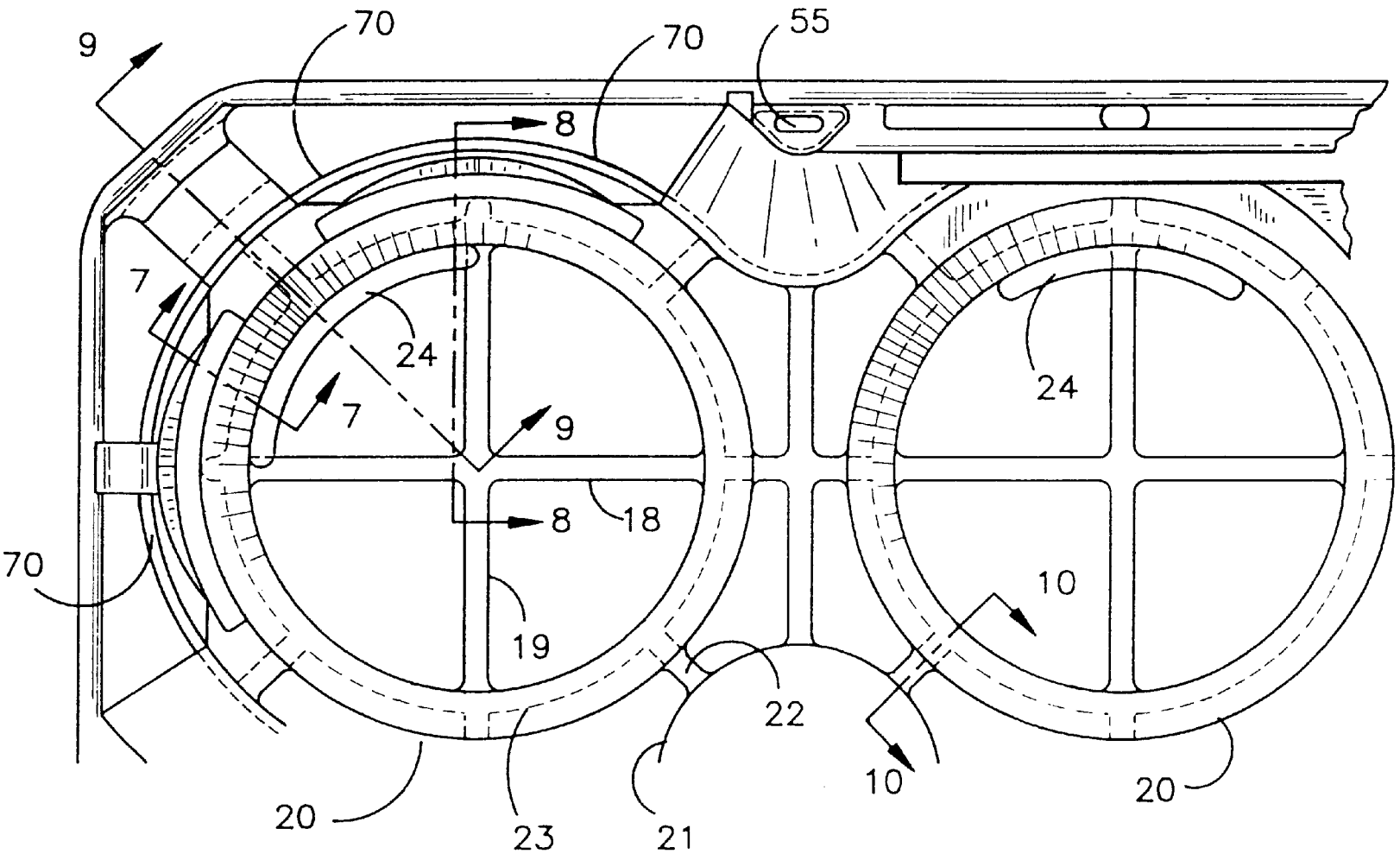
FIG. 6 is a greatly enlarged fragmentary plan view of one corner portion thereof.
Figure 12:
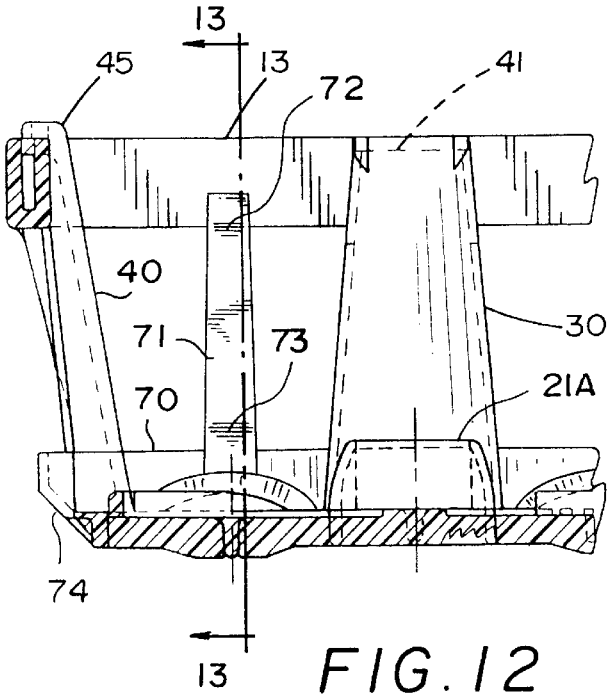
FIG. 12 is an enlarged fragmentary sectional view taken along line 12—12 in FIG. 3.

A preferred embodiment of the can tray of the present invention is indicated generally at 10 in FIGS. 1–5. The tray comprises a bottom 11 having a plurality of spaced apart upstanding pillars or columns 12 about its periphery, supporting a top rail 13 at their upper ends. In the construction shown, the tray has two long sides 14 and 15 and two shorter sides or ends 16 and 17, with a width to length relationship of 2:3, and adapted to hold four cans across its width and six cans along its length, for a total of twenty-four cans. It should be understood, however, that the principles of the invention could be incorporated in trays having different dimensional relationships and capacities for holding different numbers of cans or other containers.

The floor 11 is formed by a plurality of parallel, uniformly spaced apart longitudinal struts 18 and a plurality of parallel, uniformly spaced apart transverse struts 19, intersecting the longitudinal struts at right angles thereto. The struts define an open grid-like structure that is lightweight and requires less material in the manufacture of the tray. Further, this open grid-like configuration provides drainage for any liquids or other debris that may fall into the tray.

The struts support a plurality (twenty-four) of circular can seating areas 20 distributed uniformly over the bottom of the tray, and a plurality of upwardly extending, generally frustoconically shaped spacer members 21 and 21A in locations between the can seating areas. It will be noted that the four spacer members 21A in the corners of the tray floor are taller than the spacer members 21 distributed over the rest of the floor. These different height spacer members, particularly the taller members in the corners, provide greater stability to a stack of empty trays. Diagonal struts 22 extending between the bases of the spacer members and the undersides of adjacent portions of the circular can seating areas serve to join the spacer members to the can seating areas.

The circular can seating areas are each defined by a relatively narrow annular wall or seat 23 that is tapered downwardly toward its center so that cans placed on the circular seating area are automatically centered on the seat. The upper surface of the can seating area is relatively unobstructed, since the struts extend on the underside thereof. Each circular seating area is dimensioned for supporting contact with the rim on the bottom end of a can, and the side wall of the can extends outwardly into close proximity with the adjoining upwardly projected spacer members so that the cans are held in their respective seating areas even if the tray is disposed at a relatively steep angle of inclination. In other words, the sides of the cans will engage against the spacer members to prevent dislocation and sliding movement of the cans across the floor of the tray.

Other than the angled circular can seating surfaces and the upwardly projecting spacer members, the top surface of the floor of the tray is relatively flat and unobstructed. It should be noted, however, that those can seating areas disposed around the outer periphery of the floor of the tray each has a relatively short, upstanding, arcuately shaped lip or flange 24 at the inner margin of the tapered seating surface and on the side of the seating area disposed outwardly toward the adjacent side of the tray. These arcuately shaped flanges serve to help retain cans in position on the seating areas as more fully described in applicant's earlier patent, U.S. Pat. No. 5,188,233.

In the specific configuration described and illustrated herein, there are five upstanding pillars 30–34 spaced along each long side of the tray, not counting the corner posts 40 at the corners of the tray, and two upstanding pillars 35 and 36 spaced along each end of the tray. The pillars 30–36 are disposed on lines bisecting the space between adjacent rows of circular can seating areas, and are integrally joined at their base ends to the adjacent ends of struts extending along those lines. It will be noted that the struts to which the pillars are attached form the intersecting grid members which support the spacer members.

The pillars 30–36 are generally identically constructed, and each has an arcuately curved transverse cross-sectional shape, tapering to a wider base adjacent the floor of the tray and a narrower top at the rail. Further, the center pillar 32 along each long side of the tray terminates at its upper end 41 at the bottom edge 42 of the top rail, whereby the rail in this location is relatively smooth and unobstructed, enhancing the ergonomics of the tray by providing a smooth portion which may be grasped by a person handling the tray. Termination of the center pillar at the bottom edge of the top rail also eliminates any sink marks that might otherwise occur during manufacture of the tray, resulting in a smooth, flat, vertical outer surface 43 on the rail which is especially suited for receiving the logo of a company, or other graphics, as desired.

The two pillars 31 and 33 on either side of the center pillar extend upwardly across the width of the inner surface of the top rail, and have upwardly projecting tabs 45 on their upper ends extending beyond the top edge 46 of the rail. These tabs cooperate with the rail and concave side of the pillars when the trays are stacked together in nested relationship, as more fully described hereinafter.

The two endmost pillars 30 and 34 along each side extend upwardly at their upper ends along the inner surface of the top rail, but terminate essentially level with the top of the rail.

The two pillars 35 and 36 on each end of the tray also extend upwardly along the inner surface of the top rail, and have tabs 45 on their upper ends projecting upwardly beyond the top edge of the rail.

Figure 24:
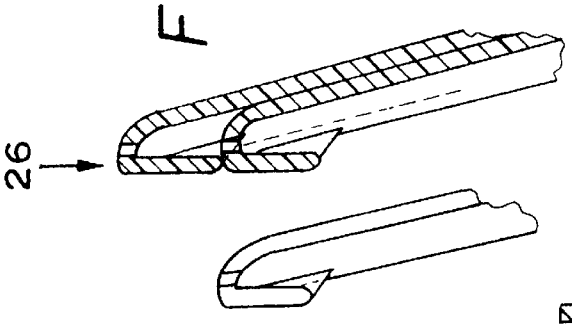
FIG. 24 is an enlarged fragmentary sectional view taken along line 24—24 in FIG. 4, but showing a pair of trays stacked together in nested relationship.
Figure 25:
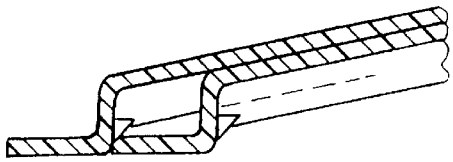
FIG. 25 is an enlarged fragmentary sectional view taken along line 25—25 in FIG. 4, but showing a pair of trays stacked together in nested relationship.
Figure 23:
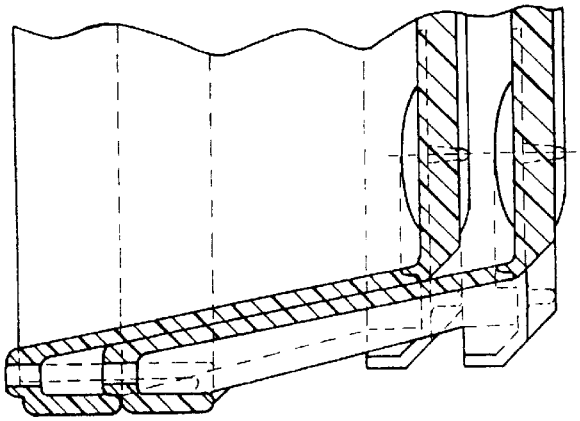
FIG. 23 is an enlarged fragmentary sectional view taken along 23—23 in FIG. 4, but showing a pair of trays stacked together in nested relationship.
Figure 29:
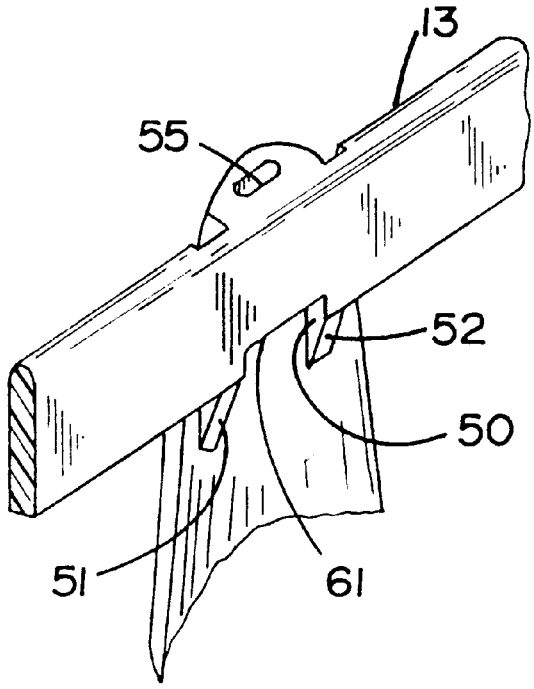
FIG. 29 is an enlarged fragmentary perspective view of a portion of the top rail and an associated pillar, showing the cut-out provided for engagement with a tool to remove the tray during the hot-stamping process.
Figure 28:
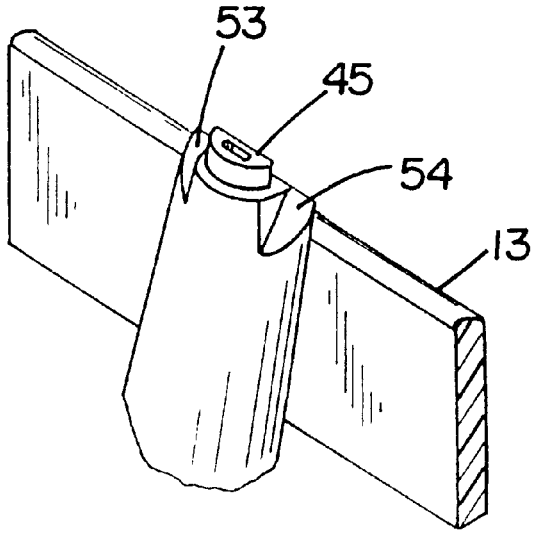
FIG. 28 is an enlarged fragmentary perspective view of a portion of a pillar and top rail, showing the angled webs and cooperative notches for secure, compact nesting engagement of the trays and to prevent shingling and/or wedging of the trays when they are nested in stacked relationship with one another.

Thus, when empty trays are stacked together in nested relationship with one another (see FIGS. 23–25), the tabs on the opposite ends of each tray and at spaced locations along the opposite sides interengage with the rail on the super-adjacent tray to prevent wedging of the trays. More specifically, the tabs 45 on the upper ends of the pillars 31, 33, 35 and 36 extend into the space 50 defined between the arcuately curved pillars and the generally vertically oriented wall of the top rail, assuring that the side walls of a sub-adjacent tray will not spread under the weight of a tray nested therein. This is especially important when a large number of empty trays are stacked together in nested relationship.

To prevent shingling of the trays, a pair of tapered ramps or webs 51 and 52 are formed at the upper end of each pillar and extend on an angle between the bottom edge of the rail and a point on the concave side of the pillar at a position spaced below the bottom edge. To prevent interference between these ramps and the top edge of a sub-adjacent rail in which a tray is stacked, the top edge of the rail is notched at 53 and 54 adjacent the upper end of each pillar in a position corresponding with the location of the ramps so that when the trays are nested the ramps lie in the these notches, thereby enabling deeper nesting of the trays.

In order to permit drainage of any water that might enter into the cavity formed between the concave surface of the pillars and the back surface of the rail, a small opening 55 is formed through the top of each pillar.

It will be observed that there is no pillar in the center of each end wall, leaving a relatively large unobstructed section of rail 60. Further, this section of rail is thicker than the remainder of the rail, forming a relatively comfortable handle for grasping and handling the tray.

Because the trays of the invention are able to nest very compactly, with the bottom edge of the top rail on an upper tray essentially engaged against the top edge of the rail on a lower tray due to the nesting structure described above, notches 61 are provided in the bottom edge of the rail at the locations of the endmost pillars 30 and 34 along each long side of the tray to enable automated equipment (not shown) to be used to remove the trays from a stack of trays during, e.g., the manufacturing process.

To prevent damage to the heels of cans disposed around the periphery of the tray, relatively narrow, arcuately shaped, upstanding heel protector bands 70 are joined to and extend between the base ends of adjacent pillars in circumferentially outwardly spaced relationship to the peripheral can seating areas. It will be noted that the directions of curvature of the pillars 30–36 and the heel protectors 70 are oppositely oriented, whereby a smoothly curved serpentine configuration results around the perimeter of the floor of the tray. The heel protectors are dimensioned so that they are spaced slightly outwardly from the base end of a can seated in the adjacent can seating area so that impacts against the heel protector are not transmitted directly into the can sidewall. The heel protector is especially beneficial when the trays are being handled with handcarts or forklifts.

Figure 13:
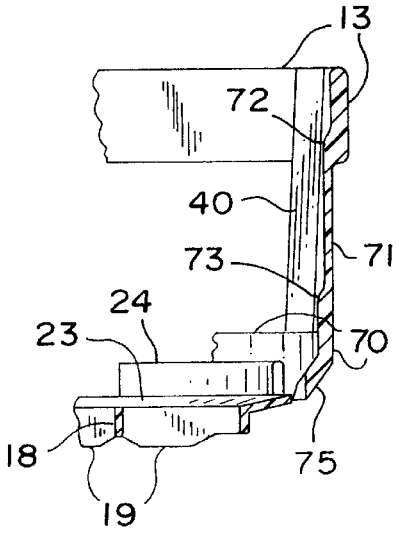
FIG. 13 is an enlarged sectional view taken along line 13—13 in FIG. 12.
Figure 11:
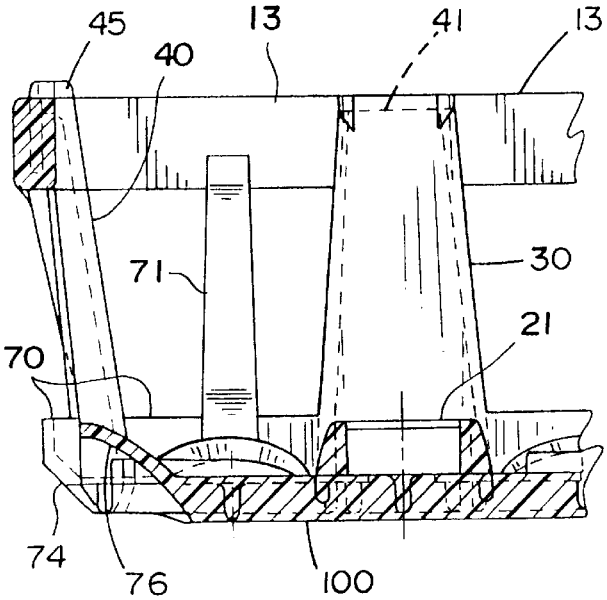
FIG. 11 is an enlarged fragmentary sectional view taken along line 11—11 in FIG. 3.
Figure 14:
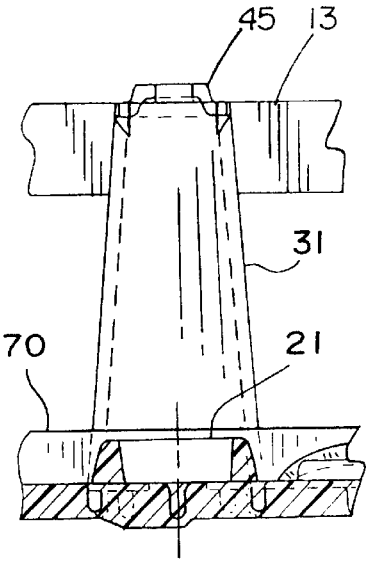
FIG. 14 is an enlarged fragmentary sectional view taken along line 14—14 in FIG. 3.
Figure 15:
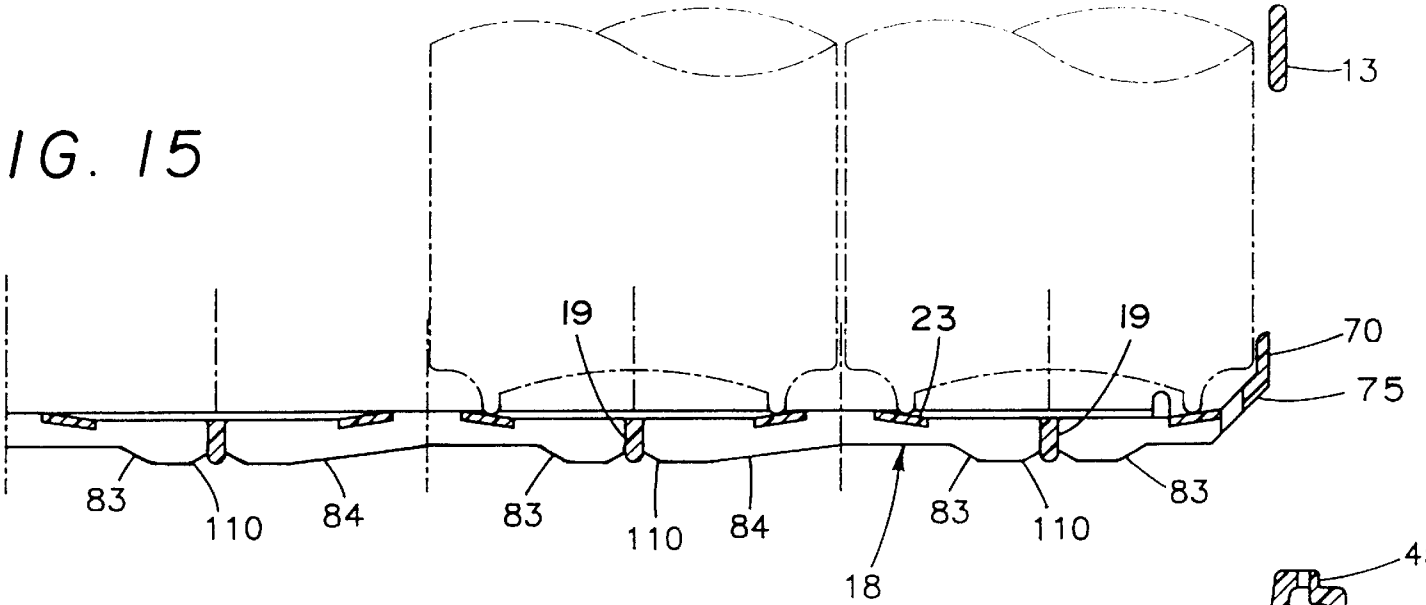
FIG. 15 is an enlarged fragmentary sectional view taken along line 15—15 in FIG. 3.
Figure 16:
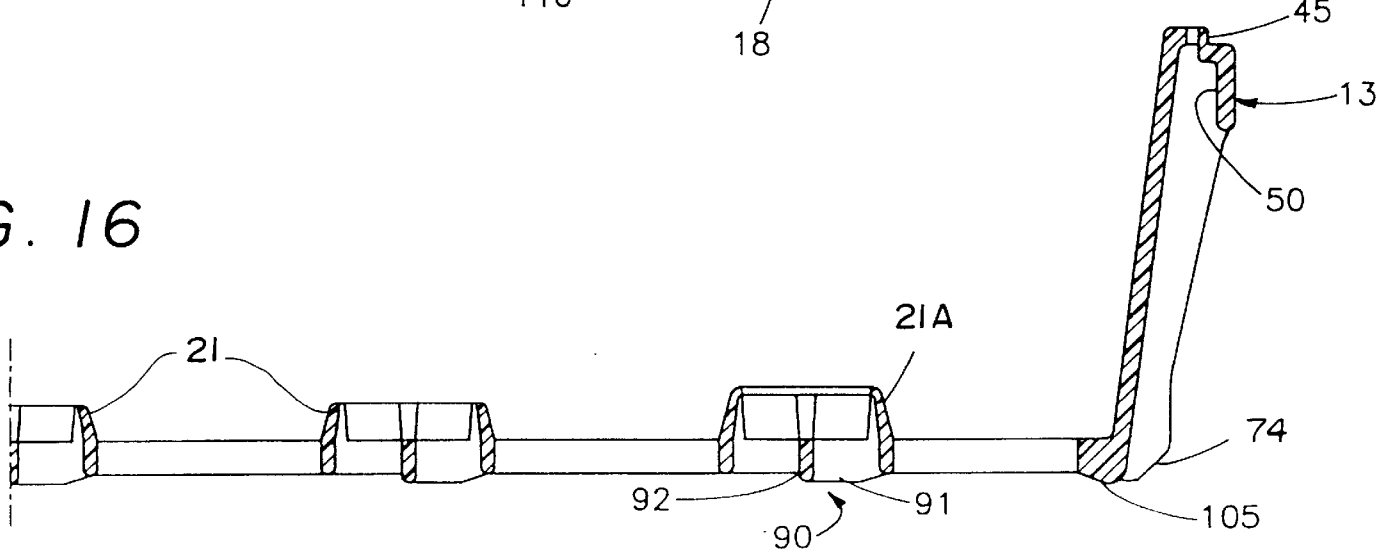
FIG. 16 is an enlarged fragmentary sectional view taken along line 16—16 in FIG. 3.
Figure 17:
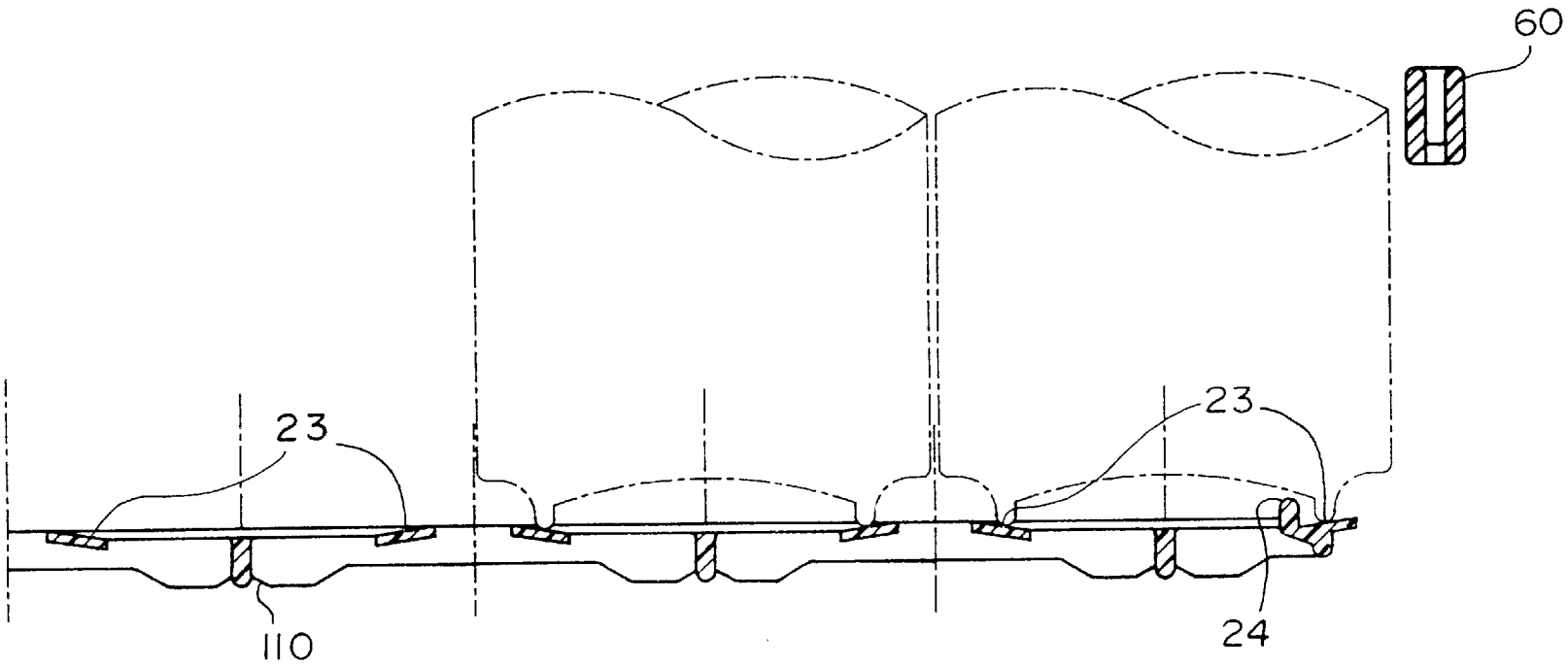
FIG. 17 is an enlarged fragmentary sectional view taken along line 17—17 in FIG. 3.
Figure 18:
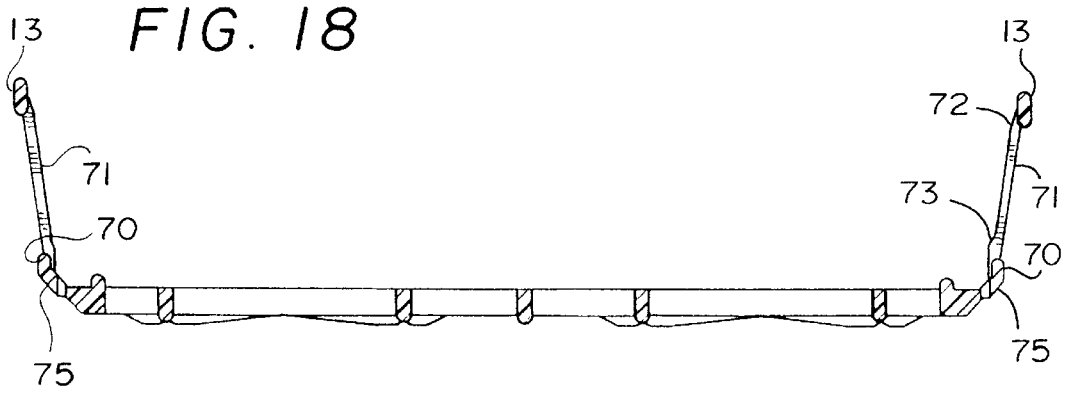
FIG. 18 is a slightly enlarged transverse sectional view taken along line 18—18 in FIG. 3.
Figure 19:
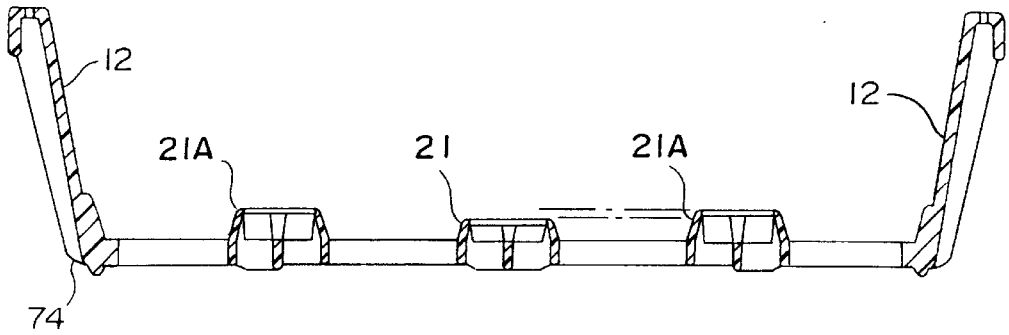
FIG. 19 is a slightly enlarged transverse sectional view taken along line 19—19 in FIG. 3.
Figure 20:
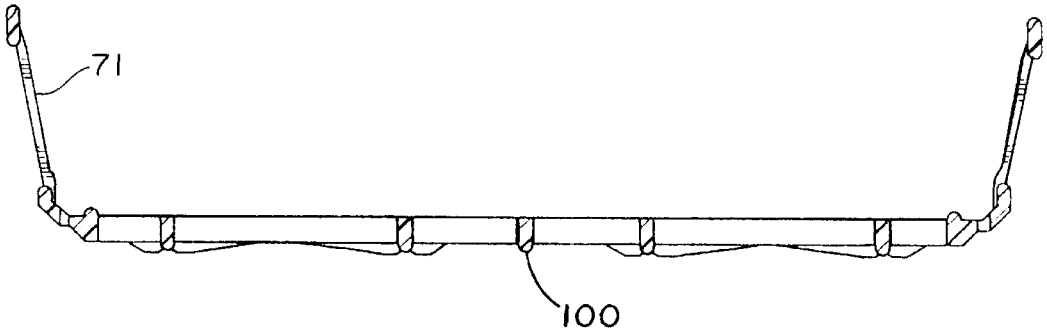
FIG. 20 is a slightly enlarged transverse sectional view taken along line 20—20 in FIG. 3.
Figure 21:
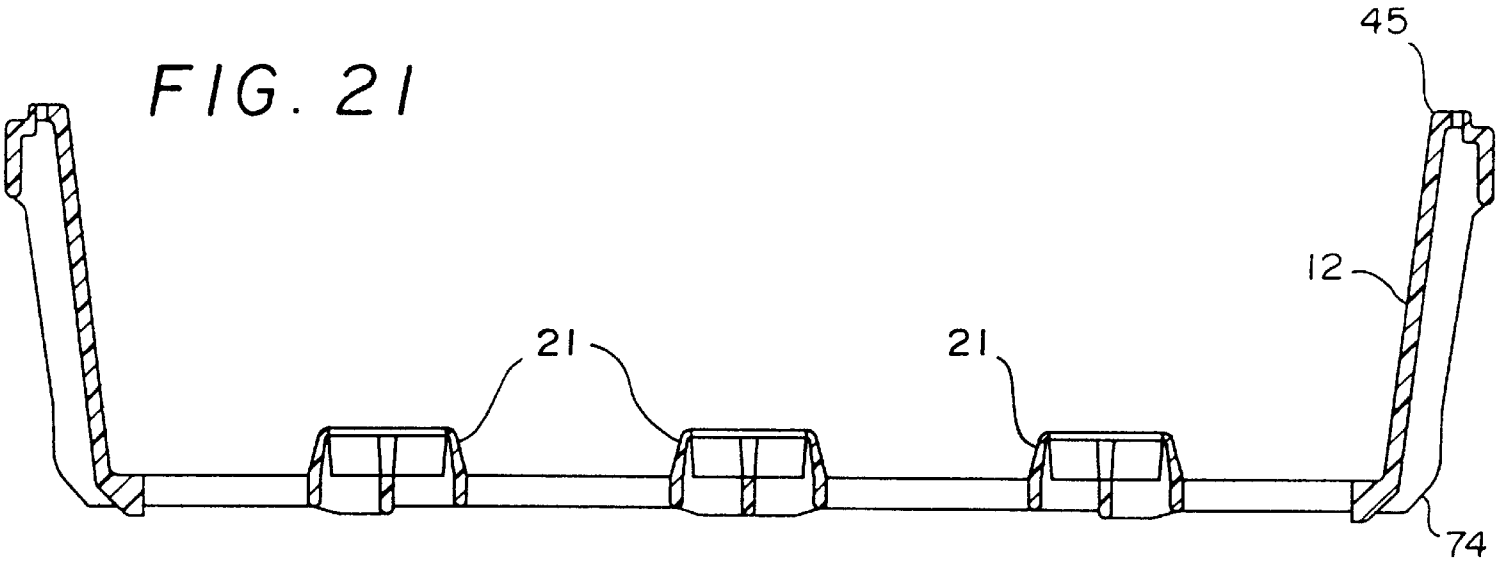
FIG. 21 is an enlarged transverse sectional view taken along line 21—21 in FIG. 3.
Figure 22:
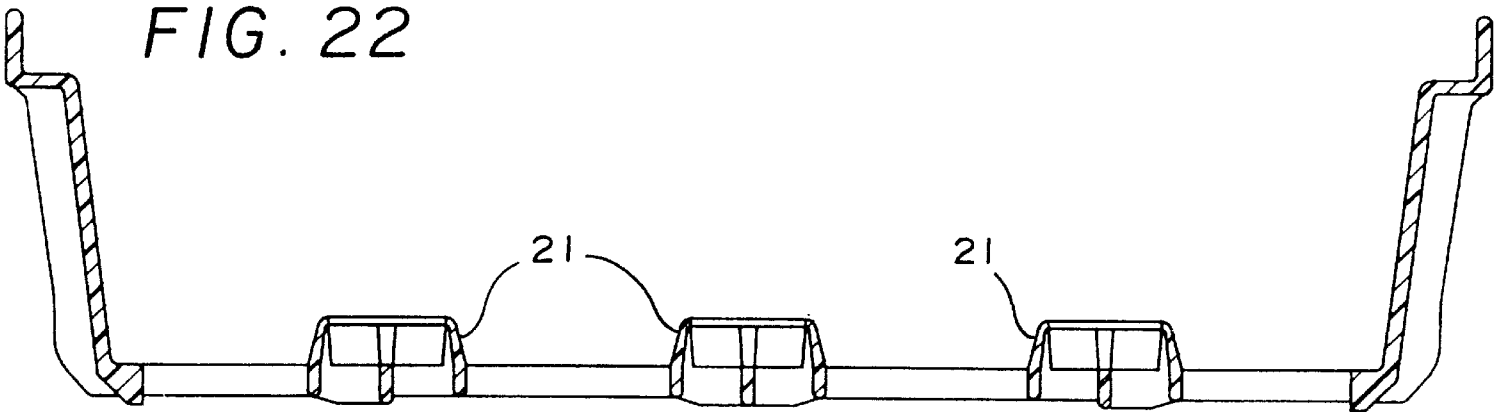
FIG. 22 is an enlarged transverse sectional view taken along line 22—22 in FIG. 3.
Figure 27:
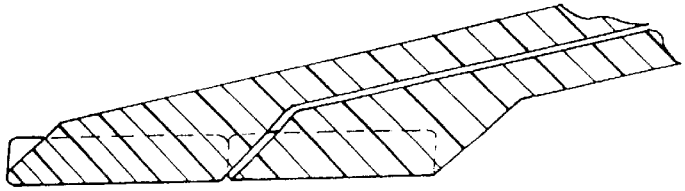
FIG. 27 is a further enlarged fragmentary sectional view taken on line 27—27 in FIG. 26.
Figure 26:
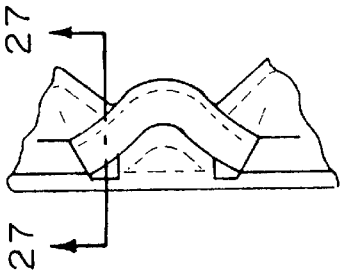
FIG. 26 is an enlarged fragmentary plan view taken on arrow 26 in FIG. 24.

As seen best in FIGS. 1, 2, 12 and 13, a strap 71 extends between the top edge of the heel protector 70 and the bottom edge of the top rail 13 to span the gap between the heel protector and the top rail. The inner surface of the strap is shaped at 72 and 73 to blend smoothly with the inner surfaces of the rail and heel protector, and as seen in FIGS. 1 and 13, the outer surface of the strap forms an uninterrupted continuation of the outer surface of the heel protector. These straps aid in the high speed feeding of a tray from an empty, nested columnar stack of trays at the loading station of a can tray packing operation. When the lower tray is forcibly stripped from the column, these straps prevent the heel of the tray from snagging the top rail, thus making a smooth and interrupted feed onto the tray conveying system.

To facilitate insertion of the blade of a handcart or the forks of a forklift beneath the tray of the invention, the base ends 74 of the pillars and the lower edge 75 of each heel protector is downwardly and inwardly tapered to provide a guide surface for guiding a lifting implement beneath the tray.

Further, to facilitate insertion of a finger or fingers beneath the ends of the tray during handling, upwardly curved recesses 76 are formed at the center of each end of the floor of the tray.

As seen best in FIGS. 2, 2A, 15–22 and 30, downwardly projecting redoubt sets 80 are formed on the bottom edges of the struts in predetermined locations to form multi-level ramps extending below the bottom plane of the floor of the tray for cooperation with the top rims of cans in a sub-adjacent tray when a plurality of loaded trays are stacked on top of one another to prevent free lateral movement of one tray relative to the other, enabling the trays to be stably stacked together. At the same time, the redoubts should permit the loaded trays to be moved or slid laterally over one another, when desired, so that a tray can be slid off of the stack without having to first lift it vertically away from the stack. The redoubt sets each comprise orthogonally disposed, downward projections 81 and 82 on the underside of the laterally and longitudinally extending struts, respectively, beneath the can seating areas, with the projections intersecting one another at right angles at a point aligned substantially with the center of each can seating area. Opposite ends of the redoubts are tapered at 83 to facilitate movement over the rim of a can, and at least one downward projection 84 in each set is longer than the other redoubts in that set and extends beyond the rim of a can so that when the trays are stacked on top of one another this longer redoubt spans the rim of the can, facilitating initial lateral movement of one tray relative to another.

Figure 30:
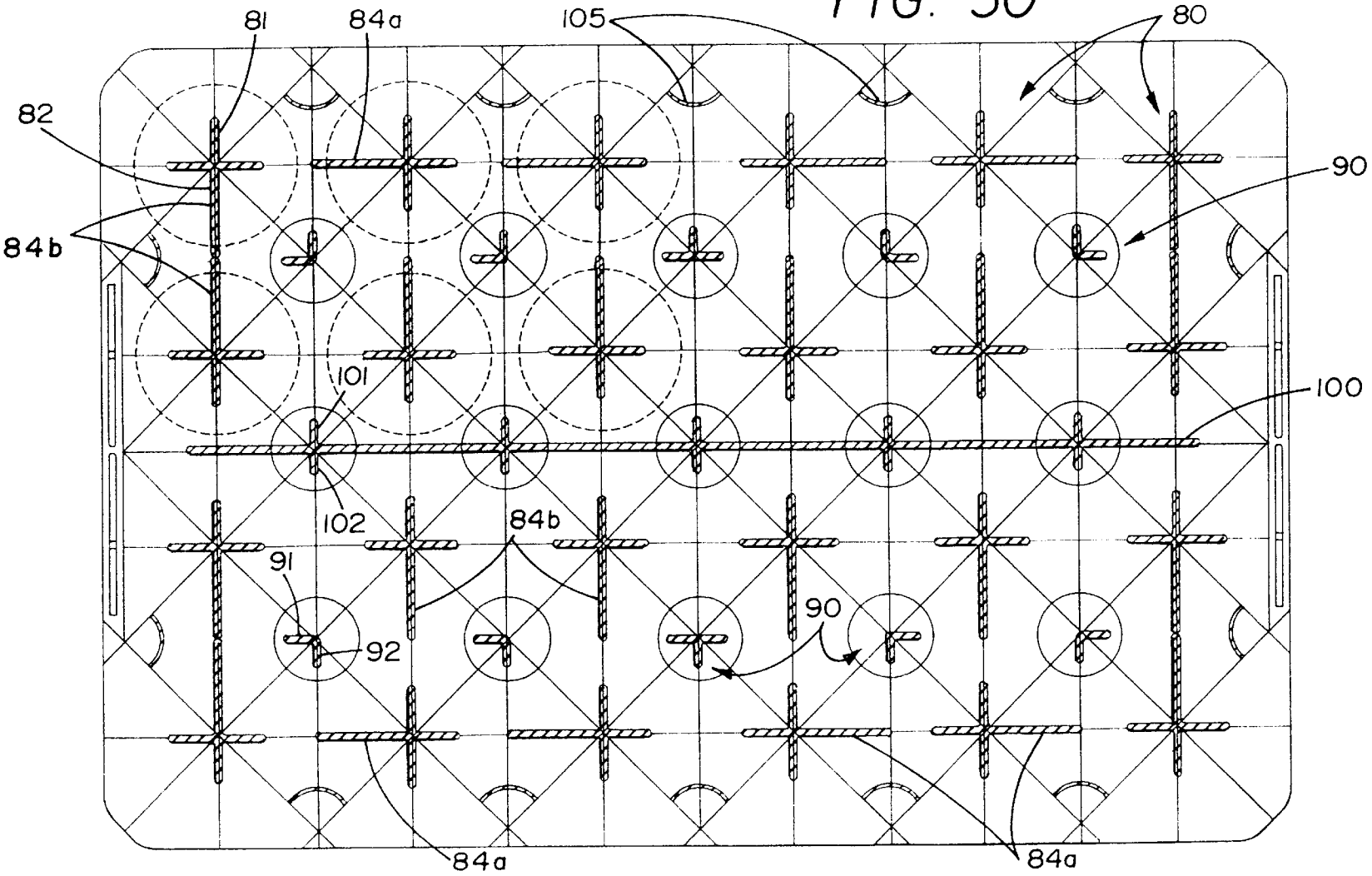
FIG. 30 is a schematic bottom plan view of the tray of the invention, showing the relationship between the redoubts on the bottom of the tray and the rims (shown in broken lines) of cans in a sub-adjacent tray, when stacked in columnar relationship.

As seen in FIG. 30, the longer redoubt 84*a* in the redoubt sets extending along the opposite sides of the tray extend in a longitudinal direction parallel to the adjacent side, while the longer redoubt 84*b* in the redoubt sets spaced inwardly of the tray floor and along opposite ends of the tray extend in a direction transverse to the long dimension of the tray. The remaining redoubts are relatively short, and when centered relative to a can end lie within the space bounded by the rim of the can. This arrangement ensures that the long redoubt member will span the rim of a can in a sub-adjacent tray when the trays are stacked in columnar relationship, as well as when they are cross-stacked.

Downwardly projecting redoubt sets 90 are also formed on the underside of the laterally and longitudinally extending struts extending beneath the spacer members 21. These redoubt sets similarly comprise downward projections 91 and 92 intersecting one another at right angles at a point coinciding with the center of the respective spacer members. Except along the longitudinal centerline of the tray, these redoubts do not cross one another but instead intersect to form an "L" shaped configuration in plan view. These redoubts are oriented so that one leg thereof points longitudinally toward the adjacent end of the tray, and the other leg points transversely toward the adjacent long side of the tray, with the redoubts on opposite sides of the transverse centerline of the tray pointing in opposite directions toward the respective opposite ends of the tray.

A single, long, continuous redoubt or rib 100 is formed on the underside of the strut extending along the longitudinal centerline of the tray, defining a continuous, uninterrupted surface extending longitudinally of the tray. Relatively short, transversely extending redoubts 101 and 102 intersect this rib at points corresponding to the center of the spacer members lying along the longitudinal centerline of the tray.

Figure 31:
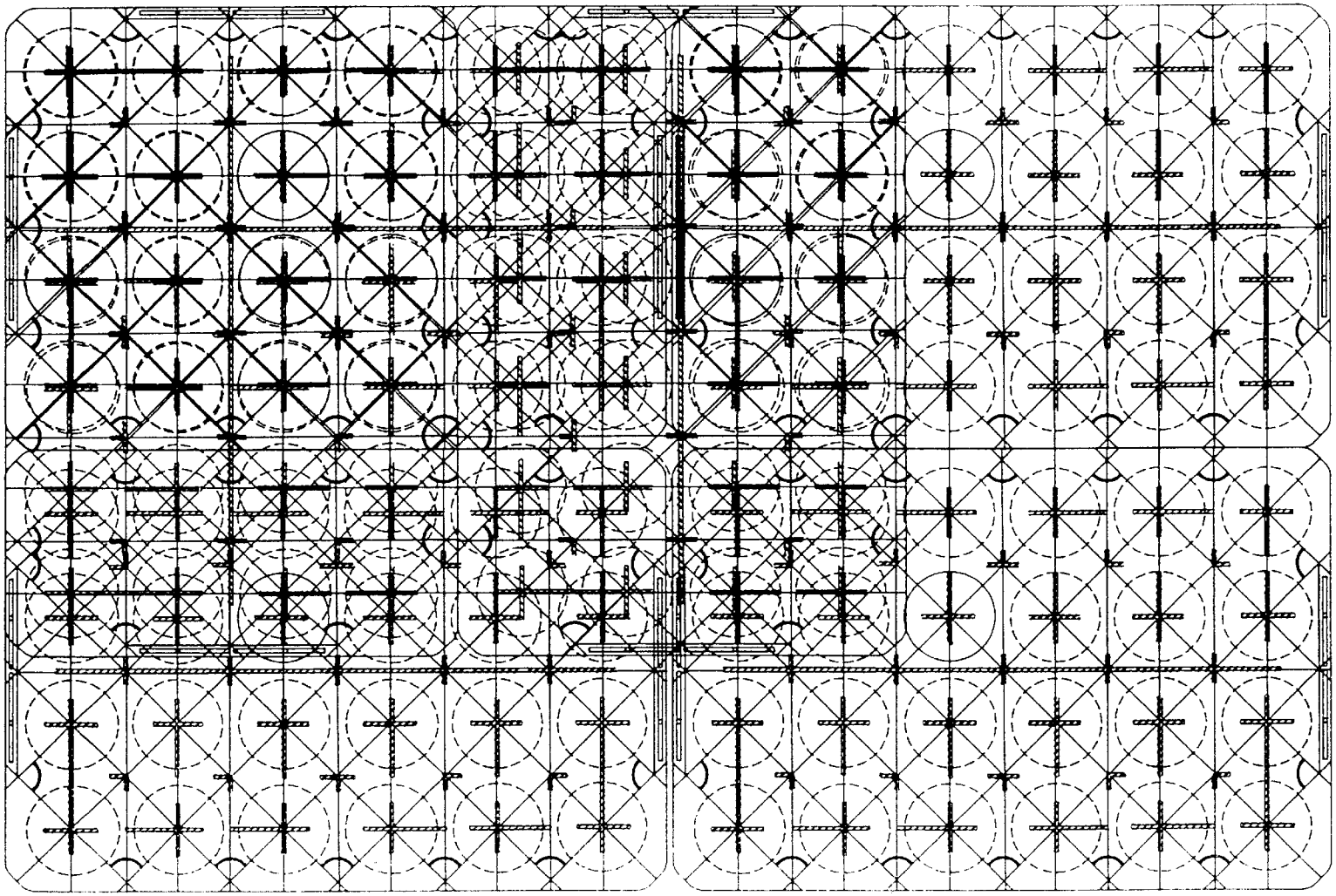
FIG. 31 is a schematic bottom plan view showing the relationship of the redoubts and can rims when the trays are cross-stacked.

Further, in one form of the invention the lower ends of the pillars extend downwardly to form arcuately shaped redoubts 105 around the outer periphery of the tray bottom. However, these redoubts 105 may be omitted, if desired, as seen in FIG. 31, for example.

With the exception of those redoubt sets 90 lying beneath the spacer members 21, the redoubts are recessed at 110 at their crossing points to avoid interference with the pull tab on sub-adjacent cans when loaded trays are stacked on top of one another in columnar relationship.

The dimensions of the redoubts and their orientation as depicted in FIG. 30 are such that redoubts will be engaged with both the inner and outer sides of the rims of cans when the trays are stacked, with the exception of those redoubt members 84*a* and 84*b* which extend in spanning relationship to the rims of the cans to facilitate initial sliding movement of one tray over the tops of cans in a sub-adjacent tray.

The sidewall height in the tray of the invention is greater than the sidewall height of a conventional tray in order to improve the stability of cans in the tray when the tray is held at an angle. In conventional trays the sidewall height is only about 2 inches, or less, whereas in the present invention the sidewall height is approximately 50% greater, with the upper edge of the top rail being approximately 2⅞ inches above the floor of the tray. This height not only provides greater stability to cans in the tray when the tray is held at a steeply inclined angle, but at the same time leaves the UPC code visible on most major brands.

While particular embodiments of the invention have been illustrated and described in detail herein, it should be understood that various changes and modifications may be made to the invention without departing from the spirit and intent of the invention as defined by the scope of the appended claims.

What is claimed is:

1. A beverage can tray for holding a quantity of cans of beverage, said tray comprising:

a tray floor having a top surface, a bottom surface and a periphery, and a plurality of spaced apart can seating means distributed over the top surface for seating a plurality of cans in spaced apart relationship to one another;

upstanding sidewall means extending upwardly from the floor top surface around the periphery of the floor for confining and stabilizing the cans supported on the floor, said sidewall means being of open construction with openings therein through which the sides of cans supported in the tray are exposed around the periphery of the tray; and heel protector means extending across a bottom portion of said openings to protect the heels of cans supported in the tray from damage due to contact with means outside the tray, said heel protector means comprising relatively narrow upstanding bands extending across said openings above said floor.

2. A beverage can tray as claimed in claim 1, wherein:

said sidewall means comprises a plurality of upright, spaced apart pillars extending upwardly from their lower ends at the periphery of the tray floor to an upper end spaced above the tray floor, said openings extending between said spaced apart pillars; and the bands forming said heel protector means are joined to and extend between the lower ends of the pillars.

3. A beverage can tray as claimed in claim 2, wherein:

said can seating means comprise circular rings having an annular upper can seating surface, some of said circular can seating rings being disposed at the periphery of the tray floor; and said heel protector bands are arcuately shaped, and are substantially concentric with the circular can seating areas in radially spaced relationship therefrom.

4. A beverage can tray as claimed in claim 3, wherein:

a bottom outer surface of said heel protector means and said pillars is downwardly and inwardly tapered to facilitate insertion of a lifting implement under the tray.

5. A beverage can tray as claimed in claim 3, wherein:

a band-like tray top rail is supported on the upper ends of the pillars, said top rail extending substantially continuously around the periphery of the tray and having a substantially smooth, flat, uninterrupted, vertical outer surface.

6. A beverage can tray for holding a quantity of cans of beverage, said tray comprising:

a tray floor having a top surface, a bottom surface and a periphery, and a plurality of spaced apart can seating means distributed over the top surface for seating a plurality of cans in spaced apart relationship to one another;

upstanding sidewall means extending upwardly from the floor top surface around the periphery of the floor for confining and stabilizing the cans supported on the floor; and at least one portion of the periphery of the tray floor being deformed upwardly to define recess means under the periphery of the tray floor, unconnected with the sidewall means, and defining shaped finger access openings under an edge of the tray floor for insertion of a finger or fingers beneath the edge of the tray floor, said finger access openings forming a lifting surface at the periphery of the tray floor to facilitate lifting of the tray.

7. A beverage can tray for holding a quantity of cans of beverage, said tray comprising:

a tray floor having a top surface, a bottom surface, a periphery, and a plurality of spaced apart can seating areas distributed over the top surface for seating a plurality of cans in spaced apart relationship to one another;

upstanding sidewall means extending upwardly from the floor top surface around the periphery of the floor for confining and stabilizing the cans supported on the floor; and a plurality of upwardly projecting spacer members distributed over the floor top surface in locations spaced between the can seating areas to extend between cans supported on the tray and maintain the cans in spaced relationship to one another and to prevent displacement of the cans across the tray floor when the tray is tilted, said spacer members projecting upwardly only a short distance relative to the height of the cans so as to engage a bottom end portion of the cans to prevent the cans from sliding across the tray floor when the tray is only partially full of cans and is tilted at an angle, said spacer members including members adjacent corners of the floor that are higher than the remaining spacer members distributed over the floor of the tray, to increase the stability of a stack of trays superposed on ton of one another.

8. A beverage can tray for holding a quantity of cans of beverage, said tray comprising:

a tray floor having a top surface, a bottom surface and a periphery, and a plurality of spaced apart can seating areas distributed over the top surface for seating a plurality of cans in spaced apart relationship to one another;

upstanding sidewall means extending upwardly from the floor top surface around the periphery of the floor for confining and stabilizing the cans supported on the floor, said sidewall means comprising a plurality of upright, spaced apart pillars extending from the periphery of the tray floor at their lower ends to an upper end spaced above the tray floor, and a band-like tray top rail supported on the upper ends of the pillars, said top rail extending substantially continuously around the periphery of the tray and having a top edge and a bottom edge and a substantially smooth, flat, vertically oriented outer surface; and at least one notch formed in the bottom edge of said top rail at its vertically oriented outer surface, and extending upwardly into the rail, for engagement with a tool on automated equipment to lift the tray away from a stack of trays.

9. A tray for holding a plurality of containers for storage and shipment, comprising:

a tray floor having a top surface and a bottom surface and a plurality of spaced apart container seating areas distributed over the top surface for seating a plurality of containers in spaced apart relationship to one another;

upstanding sidewall means extending upwardly from the floor top surface around the periphery of the floor for confining and stabilizing the container supported on the floor, said sidewall means comprising a plurality of upright, spaced apart pillars extending from the periphery of the tray floor at their lower ends to an upper end spaced above the tray floor, and a band-like tray top rail supported on the upper ends of the pillars, said top rail extending substantially continuously around the periphery of the tray and having a top edge and a bottom edge and a substantially smooth, flat, vertically oriented outer surface; and denesting means extending between the top rail and the tray floor in the space between the pillars to prevent snagging or catching of the trays during denesting of empty trays.

10. A tray as claimed in claim 9, wherein:

said denesting means comprises an elongate strap extending between the heel protector means and the tray top rail, said strap serving to deflect and guide the tray top rail of one tray past the heel protector means of another tray when the trays are empty and are being denested.

11. A tray as claimed in claim 10, wherein:

upstanding heel protector means extends between said pillars at the lower ends thereof, extending above the tray floor in the spaces defined between the pillars, to shield lower end portions of containers placed in the tray from contact with objects outside the tray.

12. A tray as claimed in claim 10, wherein:

the strap defines, at its juncture with the top rail and the heel protector means, a smooth uninterrupted continuation of the top rail inner surface and the heel protector outer surface.

13. A tray as claimed in claim 9, wherein:

at least one notch is formed in the bottom edge of said top rail at its vertically oriented outer surface for engagement with a tool on automated equipment to lift the tray away from a stack of trays.

14. A beverage can tray for holding a quantity of cans of beverage, said tray comprising:

a tray floor having a top surface, a bottom surface and a periphery, and a plurality of spaced apart can seating means distributed over the top surface for seating a plurality of cans in spaced apart relationship to one another;

upstanding sidewall means extending upwardly from the floor top surface around the periphery of the floor for confining and stabilizing the cans supported on the floor, said sidewall means being of open construction with openings therein through which the sides of cans supported in the tray are exposed around the periphery of the tray;

multi-level redoubt means projecting downwardly from the underside of the tray floor a predetermined depth for cooperation with the top rims in cans supported in a sub-adjacent tray when a plurality of trays containing cans of beverage are stacked on top of one another, to impede free sliding movement of one tray over the tops of cans in a sub-adjacent tray so that the trays can be stacked together in stable relationship, but at the same time enabling said one tray to be moved laterally with respect to the sub-adjacent tray, when desired, to remove said one tray from the stack of trays, said redoubt means including an elongate redoubt of tapered depth that spans the top rim of a can; and heel protector means extending across said openings in the sidewall to protect the heels of cans supported in the tray from damage due to contact with means outside the tray, said heel protector means comprising relatively narrow upstanding bands extending across said openings above said floor.

15. A beverage can tray for holding a quantity of cans of beverage, said tray comprising:

a tray floor having a top surface, a bottom surface and a periphery, and a plurality of spaced apart can seating means distributed over the top surface for seating a plurality of cans in spaced apart relationship to one another, said can seating means comprising circular rings having an annular upper can seating surface, and some of said circular can seating rings being disposed at the periphery of the tray floor;

upstanding sidewall means extending upwardly from the floor top surface around the periphery of the floor for confining and stabilizing the cans supported on the floor, said sidewall means comprising a plurality of upright, spaced apart pillars extending upwardly from their lower ends at the periphery of the tray floor to an upper end spaced above the tray floor, defining openings between said spaced apart pillars through which the sides of cans supported in the tray are exposed around the periphery of the tray;

heel protector means extending across said openings to protect the heels of cans supported in the tray from damage due to contact with means outside the tray, said heel protector means comprising relatively narrow upstanding bands extending across said openings above said floor, said bands joined to and extending between the lower ends of the pillars and being arcuately shaped and substantially concentric with the circular can seating areas in radially spaced relationship therefrom;

a band-like tray top rail supported on the upper ends of the pillars, said top rail extending substantially continuously around the periphery of the tray and having a substantially smooth, flat, uninterrupted, vertical outer surface; and multi-level redoubt means projecting downwardly from the underside of the tray floor a predetermined depth for cooperation with the top rims in cans supported in a sub-adjacent tray when a plurality of trays containing cans of beverage are stacked on top of one another, to impede free sliding movement of one tray over the tops of cans in a sub-adjacent tray so that the trays can be stacked together in stable relationship, but at the same time enabling said one tray to be moved laterally with respect to the sub-adjacent tray, when desired, to remove said one tray from the stack of trays, said redoubt means including an elongate redoubt of tapered depth that spans the top rim of a can.

* * * * *